US009913998B2

(12) United States Patent
Cheung

(10) Patent No.: US 9,913,998 B2
(45) Date of Patent: Mar. 13, 2018

(54) AIR PURIFIER HAVING AN ELECTRET MODULE

(75) Inventor: William S. H. Cheung, London (GB)

(73) Assignee: ADC TECH INTERNATIONAL LTD, Hong Kong (HK)

( * ) Notice: Subject to any disclaimer, the term of this patent is extended or adjusted under 35 U.S.C. 154(b) by 526 days.

(21) Appl. No.: 14/004,284

(22) PCT Filed: Mar. 9, 2012

(86) PCT No.: PCT/US2012/028548

§ 371 (c)(1),
(2), (4) Date: Nov. 19, 2013

(87) PCT Pub. No.: WO2012/122500

PCT Pub. Date: Sep. 13, 2012

(65) Prior Publication Data

US 2014/0150797 A1 Jun. 5, 2014

Related U.S. Application Data

(60) Provisional application No. 61/451,389, filed on Mar. 10, 2011.

(51) Int. Cl.
*A62B 23/02* (2006.01)
*A62B 18/08* (2006.01)
(Continued)

(52) U.S. Cl.
CPC ..... *A62B 23/025* (2013.01); *A62B 18/084* (2013.01); *B03C 3/28* (2013.01);
(Continued)

(58) Field of Classification Search
None
See application file for complete search history.

(56) References Cited

U.S. PATENT DOCUMENTS 4,215,682 A * 8/1980 Kubik ..... A41D 13/1146 128/205.29
4,883,052 A * 11/1989 Weiss ..... A62B 23/025 128/205.27

(Continued)

FOREIGN PATENT DOCUMENTS

WO 2010-078569 7/2010

OTHER PUBLICATIONS

Wegener et al.; "Charging behavior and thermal stability of porous and non-porous polytetrafluoroethylene (PTFE) electrets"; 2007 Annual Report Conference on Electrical Insulation and Dielectric Phenomena; p. 449-452; IEEE; retrieved from http://ieeexplore.ieee.org/stamp/stamp.jsp?arnumber=4451621; DOI: 10.1109/CEIDP.2007.4451621.*

(Continued)

*Primary Examiner* — (Jackie) Tan-Uyen T Ho
*Assistant Examiner* — Joseph D Boecker
(74) *Attorney, Agent, or Firm* — The Belles Group, P.C.

(57) ABSTRACT

An air purifier having an electret module for capturing airborne particles, the electret module including an electret element disposed within a housing and an adhesive layer coupled to the housing to capture airborne particles, whereby the static field of the electret attracts the airborne particles, which subsequently adhere to the adhesive layer.

12 Claims, 9 Drawing Sheets

(51) Int. Cl.

| | |
|---|---|
| ***B03C 3/28*** | (2006.01) |
| ***B03C 3/30*** | (2006.01) |
| ***B03C 3/32*** | (2006.01) |
| ***B03C 3/36*** | (2006.01) |
| ***B03C 3/38*** | (2006.01) |

(52) U.S. Cl.
CPC ..... *B03C 3/30* (2013.01); *B03C 3/32* (2013.01); *B03C 3/363* (2013.01); *B03C 3/383* (2013.01)

(56) References Cited

U.S. PATENT DOCUMENTS 5,206,061 A * 4/1993 Ando ..... A42B 1/043 428/34.7
5,500,038 A * 3/1996 Dauber ..... B01D 53/0407 55/385.1
5,593,482 A * 1/1997 Dauber ..... B01D 53/0407 55/385.6
5,706,804 A * 1/1998 Baumann ..... A41D 13/1115 128/206.12
5,964,221 A * 10/1999 McKenna ..... B01D 53/0415 128/201.27
6,041,782 A * 3/2000 Angadjivand ..... A41D 13/1146 128/205.27
6,240,968 B1 * 6/2001 Bigonzi-Jaker ..... A61L 15/24 138/115
6,306,491 B1 * 10/2001 Kram ..... B01D 69/00 424/422
6,331,223 B1 * 12/2001 Wylie ..... E06B 9/52 156/160
6,395,073 B1 * 5/2002 Dauber ..... B01D 39/1692 360/99.17
6,416,184 B1 * 7/2002 Arai ..... G03B 21/145 349/5
6,543,450 B1 * 4/2003 Flynn ..... A62B 18/02 128/201.25
6,763,835 B1 * 7/2004 Grove ..... A62B 17/04 128/201.25
6,914,773 B2 * 7/2005 Yang ..... G06F 1/1609 361/679.02
6,923,182 B2 * 8/2005 Angadjivand ..... A41D 13/1146 128/205.27
6,986,804 B2 * 1/2006 Dominiak ..... B01D 46/0036 55/385.3
7,035,422 B1 * 4/2006 Wiener ..... H04R 1/025 381/301
8,568,503 B2 * 10/2013 Sasaki ..... B01D 46/543 360/97.12
2003/0090842 A1 * 5/2003 Smith ..... G11B 5/5521 360/265.9
2004/0031490 A1 * 2/2004 Haaga ..... A41D 13/11 128/206.12
2004/0105070 A1 * 6/2004 Hockaday ..... A61F 9/028 351/156
2004/0226448 A1 * 11/2004 Griffiths ..... B03C 3/14 96/67
2005/0112655 A1 5/2005 Banerjee et al.
2006/0032371 A1 * 2/2006 Dauber ..... B01D 46/0032 95/90
2008/0305101 A1 12/2008 Ruoslahti et al.
2009/0054115 A1 * 2/2009 Horrdin ..... G06F 1/1616 455/575.8
2010/0055435 A1 * 3/2010 Neubert ..... C09J 5/02 428/220
2010/0087749 A1 * 4/2010 Tovey ..... A61B 5/097 600/543
2010/0139655 A1 * 6/2010 Genosar ..... A61M 15/0065 128/203.15
2010/0254914 A1 10/2010 Park et al.
2010/0272668 A1 * 10/2010 Matsushita ..... A01N 25/34 424/78.1
2011/0041237 A1 * 2/2011 Gupta ..... A42B 1/008 2/171.3
2011/0088143 A1 * 4/2011 Lee ..... A42B 1/245 2/209.13
2011/0191941 A1 * 8/2011 Chiang ..... A42B 1/245 2/209.13
2014/0190492 A1 * 7/2014 Noh ..... A41D 13/1161 128/863

OTHER PUBLICATIONS

Lastique, "Polyvinyl Chloride (PVC)", retrieved from https://web.archive.org/web/20040712081219/http://lastique.com/PVC.htm with date Jul. 12, 2004.*
WikiHow, "How to Remove Stickers from a Laptop", retrived from https://web.archive.org/web/20081011040119/http://www.wikihow.com/Remove-Stickers-from-a-Laptop with date Oct. 11, 2008.*
Holscot Fluoroplastics Ltd., "FEP", retrieved from http://holscot.com/glossary/fep/.*
Holscot Fluoroplastics Ltd., "PVDF", retrieved from http://holscot.com/glossary/pvdf/.*
Sencadas, V., R. Gregorio Filho, and S. Lanceros-Mendez. "Processing and characterization of a novel nonporous poly (vinylidene fluoride) films in the β phase." Journal of Non-Crystalline Solids 352.21 (2006): 2226-2229.*
Wikipedia, "Polyvinyl chloride"; retrieved from https://en.wikipedia.org/wiki/Polyvinyl_chloride.*
Sunroad Products; retrieved from https://web.archive.org/web/20090516063220/http://www.sunroad-nara.co.jp/product/denshakubou/index.html with date May 16, 2009 (Googe translation to English language).*
Toray Fine Chemicals Co., Ltd., TORAYMICRON®, http://www.torayfinechemicals.com/english/products/kino/kin_001.html.*
Longo et al., Core-Shell Hydrogel Particles Harvest, Concentrate and Preserve Labile Low Abundance Biomarkers, PLos ONE, Mar. 10, 2009, vol. 4, No. 3.

* cited by examiner

AIR PURIFIER HAVING AN ELECTRET MODULE

PRIORITY

Priority is claimed as a national stage application, under 35 U.S.C. § 371, to PCT/US2012/028548, filed Mar. 9, 2012, which claims priority to U.S. provisional application 61/451,389, filed Mar. 10, 2011. The disclosures of the aforementioned priority applications are incorporated herein by reference in their entirety.

BACKGROUND OF THE INVENTION

1. Field of the Invention

The field of the present invention is air purifiers, particularly air purifiers that capture airborne particles using electret modules.

2. Background

During the course of a day, an average person takes in approximately 500 milliliters of air per breath. For each breath taken, a person can inhale numerous types of airborne particles, including dust, pollen, mold spores, bacteria, etc. These particles consist of particulate matter in the form of microscopic solids and liquid droplets. This matter can potentially carry harmful diseases, causing irritation, allergic reactions, and disease. Types of diseases which are carried by airborne particles include tuberculosis, chickenpox, measles, and influenza.

The size of airborne particles is related to their potential harm. Smaller particles, for example, those less than 10 micrometers in diameter, are known to cause the greatest harm. These particles can migrate into a person's lungs and bloodstream, potentially affecting vital organs.

Conventional methods of preventing the inhalation of airborne particles are often limited by particle size. Mesh filters worn over a person's mouth, for example, prevent inhalation of large airborne particles. These larger particles, however, are merely irritants and generally will not have a long-term impact on health. While conventional filters can function well for their intended purpose, they generally are not effective in preventing the inhalation of smaller airborne particles. The inhalation of smaller airborne particles, particularly those that are less than 10 microns is, therefore, still a concern.

SUMMARY OF THE INVENTION

The present invention is directed toward air purifiers, particularly air purifiers that capture airborne particles, using electret modules. The electret module emits an electret field that allows the purifier to capture airborne particles.

In a first separate aspect of the invention, an electret module includes an electret element disposed within a housing and an adhesive layer coupled to the housing to capture airborne particles. In general terms, electrets are materials known to emit a quasi-permanent static charge.

One or more optional configuration features may be incorporated into the air purifier, either singly or in combination. In one optional configuration, the air purifier may include a filter that a user can place over their nose and/or mouth. In another optional configuration, the air purifier may include headgear coupled to the electret module.

In a second separate aspect of the invention, the surface potential of an electret element may be restored back to its initial level or further increased using a static restorer. The static restorer includes a battery, a high voltage generator, a rectifier and a smoothing filter. Once applied, the surface potential of the electret element should be restored back to its original potential, or even higher.

Accordingly, an improved air purifier is disclosed. Advantages of the improvements will appear from the drawings and the description of the preferred embodiment.

BRIEF DESCRIPTION OF THE DRAWINGS

In the drawings, wherein like reference numerals refer to similar components.

DETAILED DESCRIPTION OF THE PREFERRED EMBODIMENTS

Figure 1:
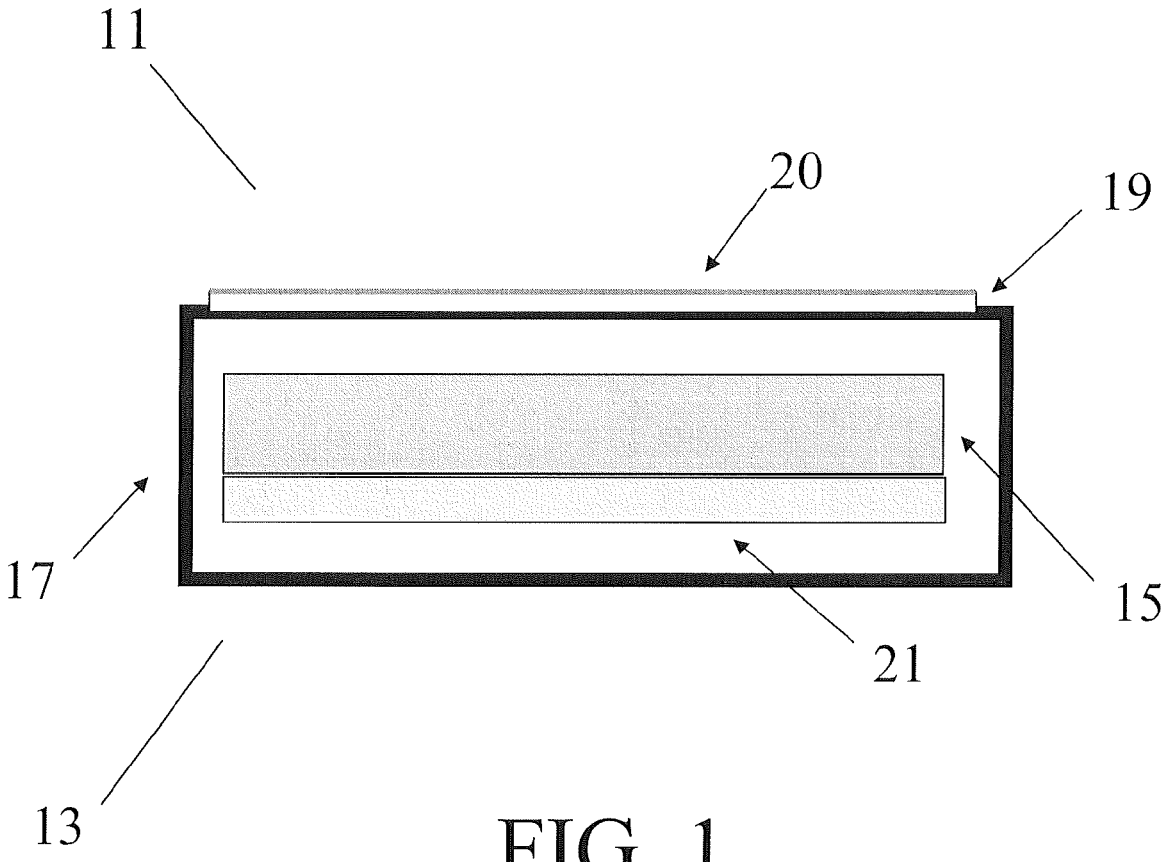
FIG. 1 schematically illustrates an air purifier shown as an electret module.

Turning in detail to the drawings, FIG. 1 illustrates an air purifier 11 formed from an electret module 13. The electret module 13 includes an electret element 15 disposed within a housing 17.

Figure 8:
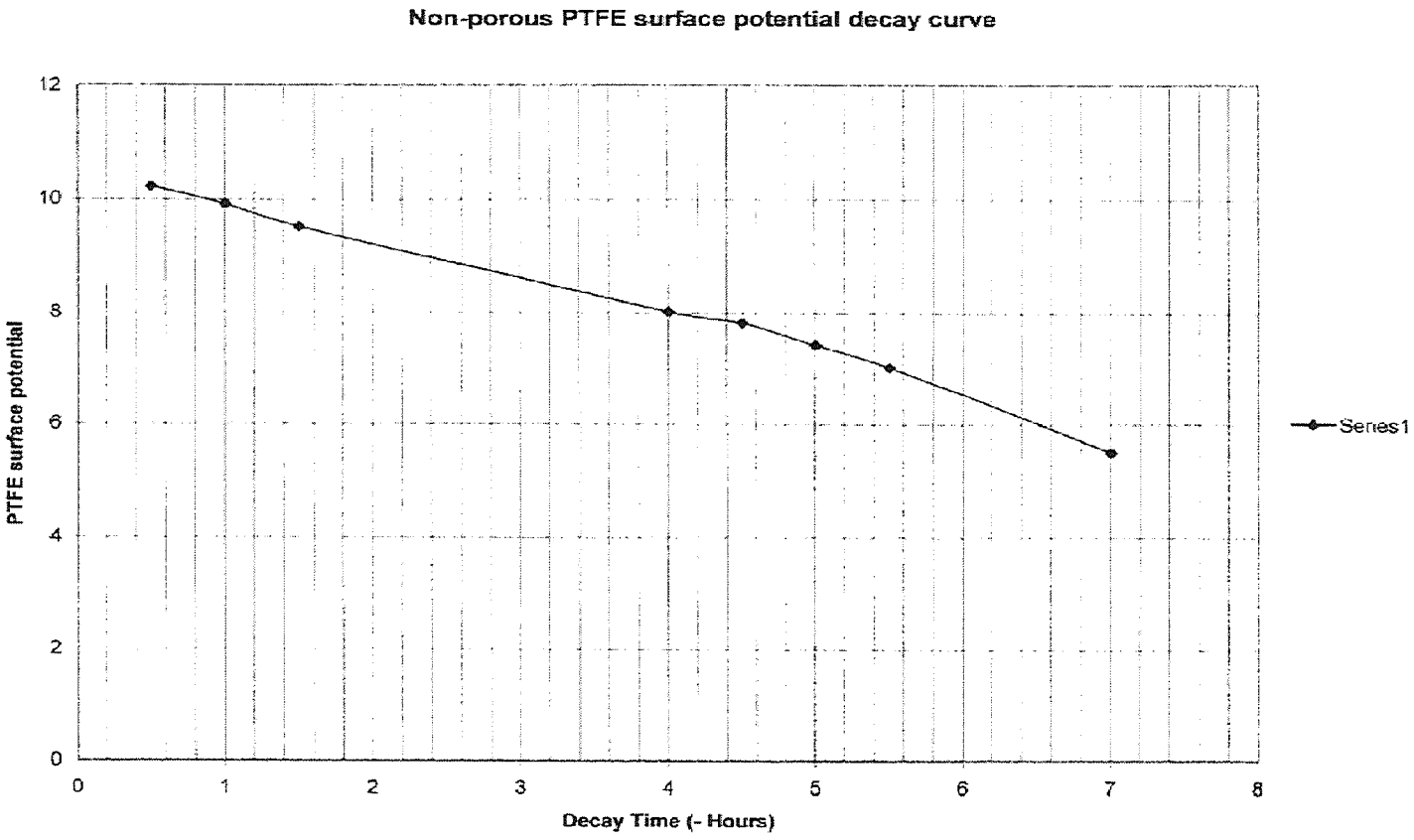
FIG. 8 is a graph illustrating the surface potential decay curve of an electret element after exposure to air.

The electret element 15 may be constructed from synthetic polymers, including fluoropolymers, polyolefins, polyesters, and the like. In one configuration, the electret element 15 is constructed from a non-porous polytetrafluoroethylene (PTFE) film. Other suitable materials may include polypropylene and ethylene terephthalate. Non-porous PTFE is one type of suitable material because of its ability to achieve a high surface potential, using thin film configurations. Non-porous PTFE, however, is known to be affected by its environment, particularly humid conditions and surrounding electric fields. The surface potential of non-porous PTFE may also be unstable and have a faster rate of a surface potential decay, in comparison to other fluoropolymer materials. FIG. 8, for example, shows a surface potential decay curve of non-porous PTFE after exposure to air.

Before being placed into the housing, the electret element 15 is charged. One method for charging the electret element is the corona discharge method. Any effective charging method, however, may be used. In optional configurations, after charging, the surface potential of the electret element can range from 2 KV to 5 KV. This range allows for the electret module to capture small airborne particles. Airborne particles contemplated and their approximate size ranges, in microns, include:

Pollens: 10-1000

Bacteria: 0.300-60

Smoke: 0.010-4

Viruses: 0.005-0.300

Because air is known to carry ionic particles and liquid droplets that may affect the surface potential of some types of electret elements, the electret element 15 is contained within a housing 17. Materials with low attenuation factors, like polyvinylchloride, are preferred as housing materials.

These types of housing materials are used to prevent moisture and ionic particles from contacting the electret element 15.

An adhesive layer 19 is disposed on the housing. In one configuration, the adhesive layer is made from a synthetic polymer like polyvinylchloride (PVC) sheet material. Preferably, this layer is detachable. The layer 19 uses an adhesive 20 that is suitable for capturing small airborne particles of the size ranges indicated above. The layer 19 is also attached to the housing 17 using an adhesive or other suitable method.

As shown, the electret module 13 includes a ground layer 21 made from metal, such as a metal foil, or another conductive material, This ground layer is an optional layer, and may be omitted from the electret module depending upon design considerations.

Figure 2:
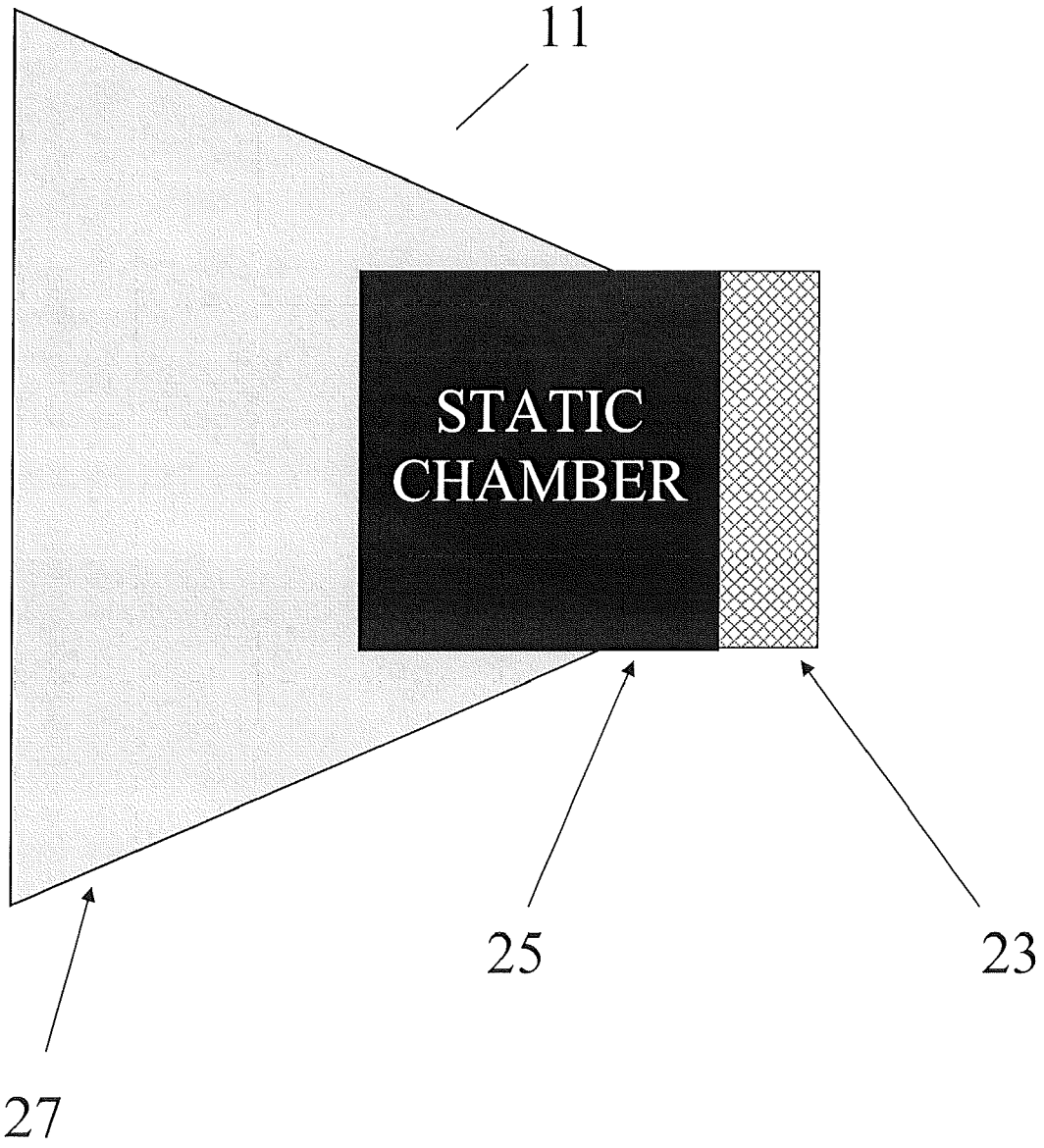
FIG. 2 schematically illustrates an air purifier.
Figure 3:
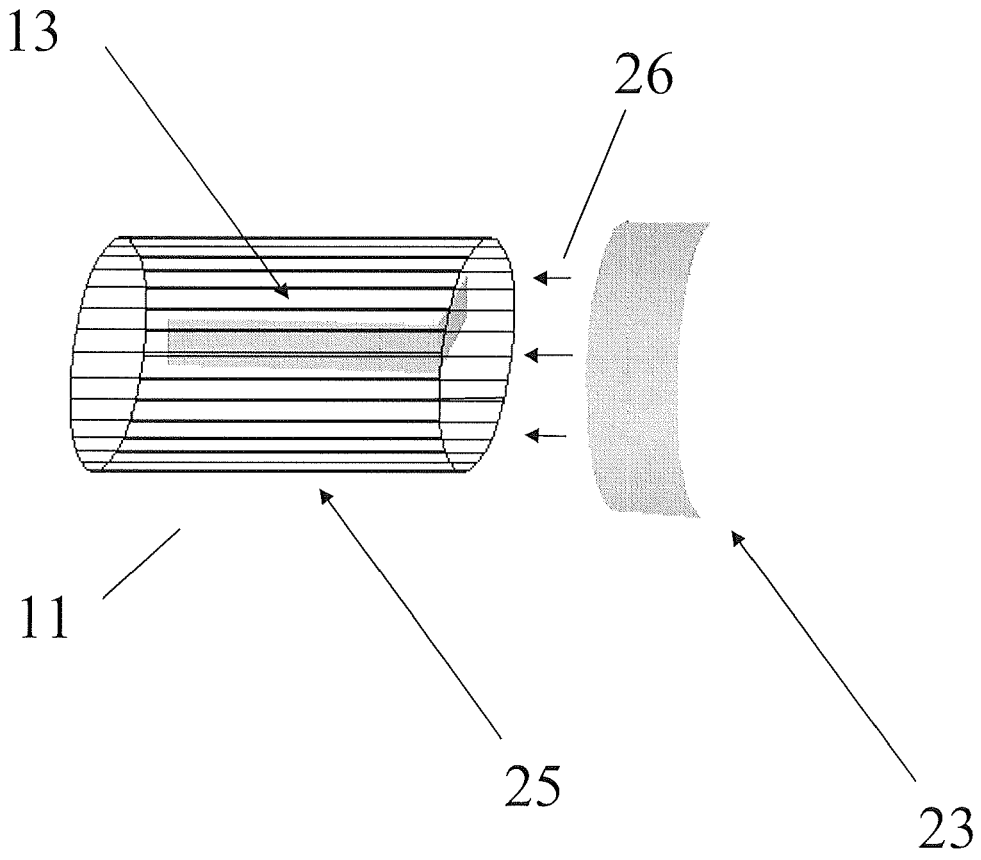
FIG. 3 schematically illustrates an air purifier.
Figure 4:
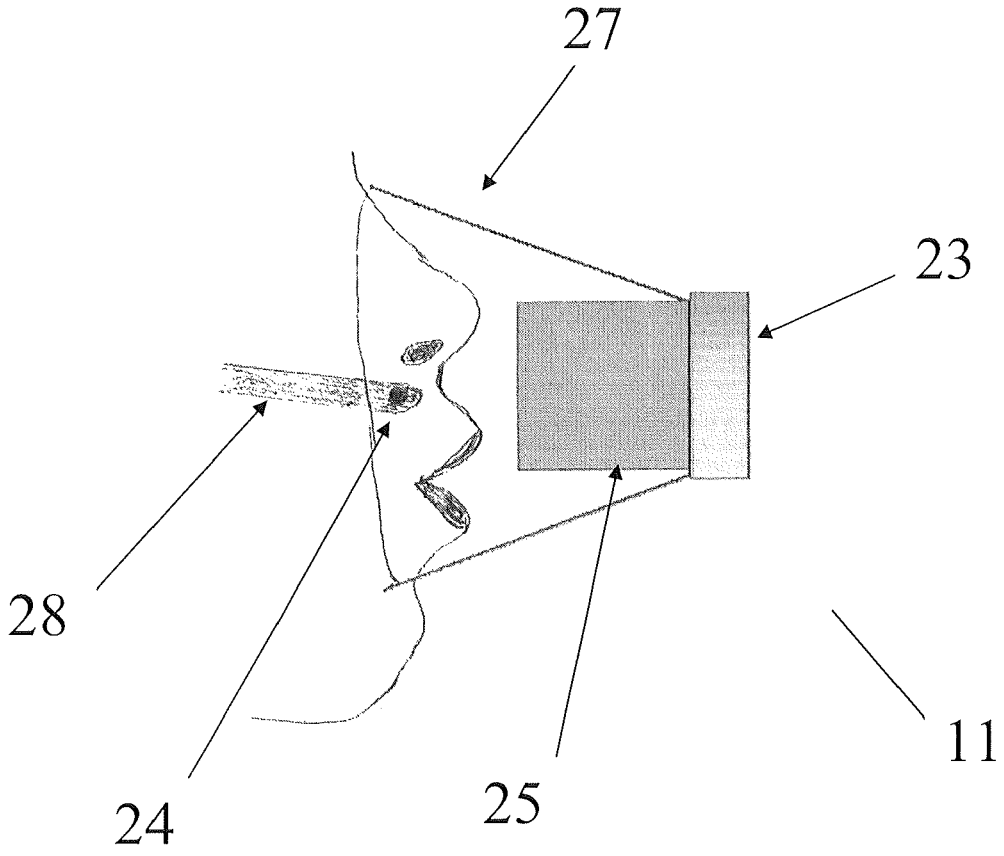
FIG. 4 illustrates a user wearing an air purifier.

In one optional configuration, as shown in FIGS. 2-4, the air purifier includes a filter 23 and a static chamber 25. The filter is made from any suitable mesh material that allows for sufficient filtration of larger airborne particles, i.e. those larger than 10 microns. In FIG. 2, an air purifier 11 having a mask 27, a static chamber 25, and a filter 23 is shown. In this configuration, the static chamber 25 is adjacent to the filter 23 and disposed within the mask 27. The mask may be made from plastic or other soft materials that allow for comfortable placement over a user's mouth and/or nose.

In FIG. 3, an electret module is shown disposed within the static chamber 25 along an air flow path 26. In this configuration, the filter 23 is adjacent to the electret element and in line with the air flow path 26. FIG. 4 illustrates a user wearing a mask 27 that incorporates the static chamber 25 and the filter 23. In this configuration, at least one strap 28 is used to hold the mask 27 securely over a user's mouth and/or nose. The strap is attached to the mask, using a pin 24 or other suitable method of attachment. The strap may be made from plastic or other soft materials that allow for comfortable placement on a user's mouth and/or nose. Optionally, the strap 28 is elastic and adapted to extend over a user's head, ears, and/or neck.

Figure 5:
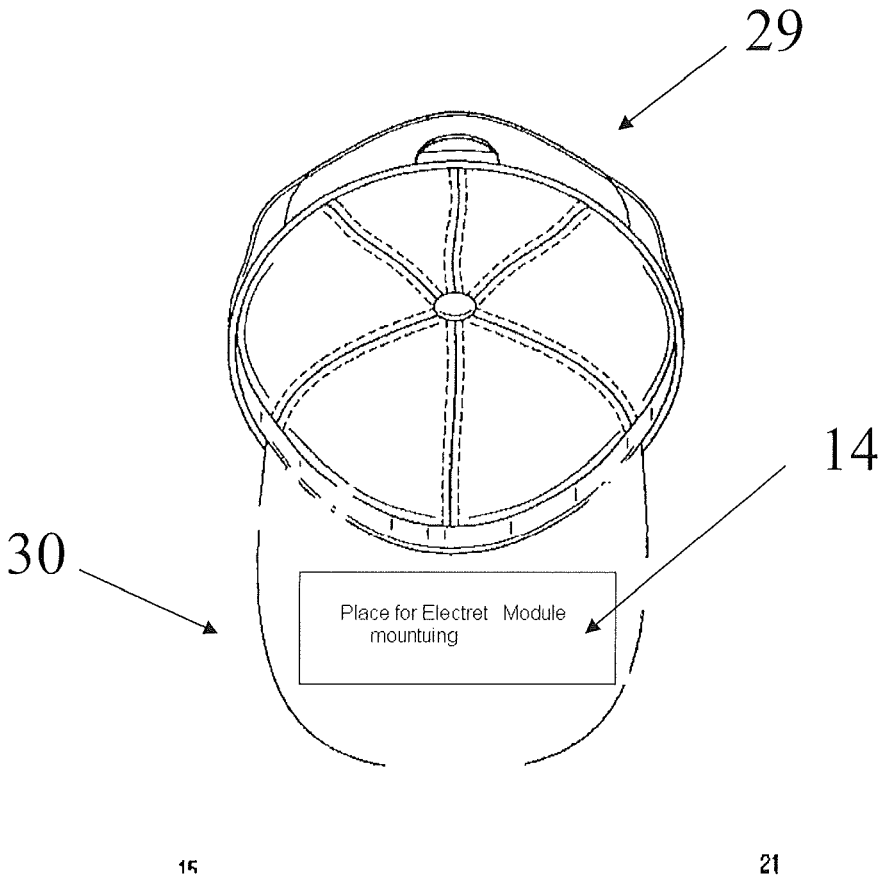
FIG. 5 illustrates an electret module attached to headgear.
Figure 6:
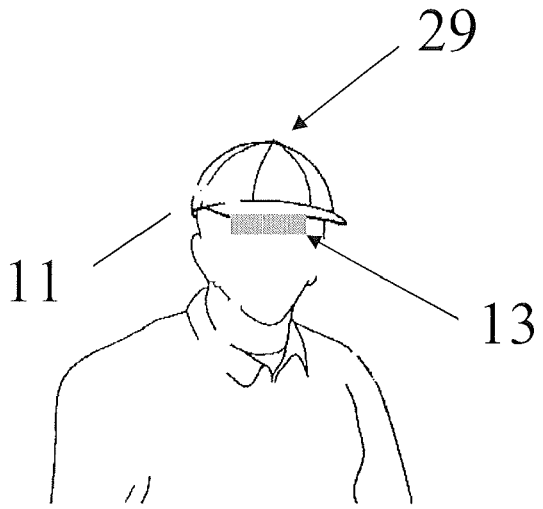
FIG. 6 illustrates an air purifier incorporated into headgear.

As shown in FIGS. 5 and 6, in other optional configurations, the air purifier includes an electret module coupled to headgear 29. Although shown as a cap, the electret module may be coupled to any type of headgear or other gear that is close enough to a person's eyes, mouth and/or nose to capture airborne particles. In FIG. 5, a module area 14 where an electret module may be coupled to a cap brim 30 is shown. In this configuration, the electret module can generate a static field (not shown) towards the face of a person.

Figure 7:
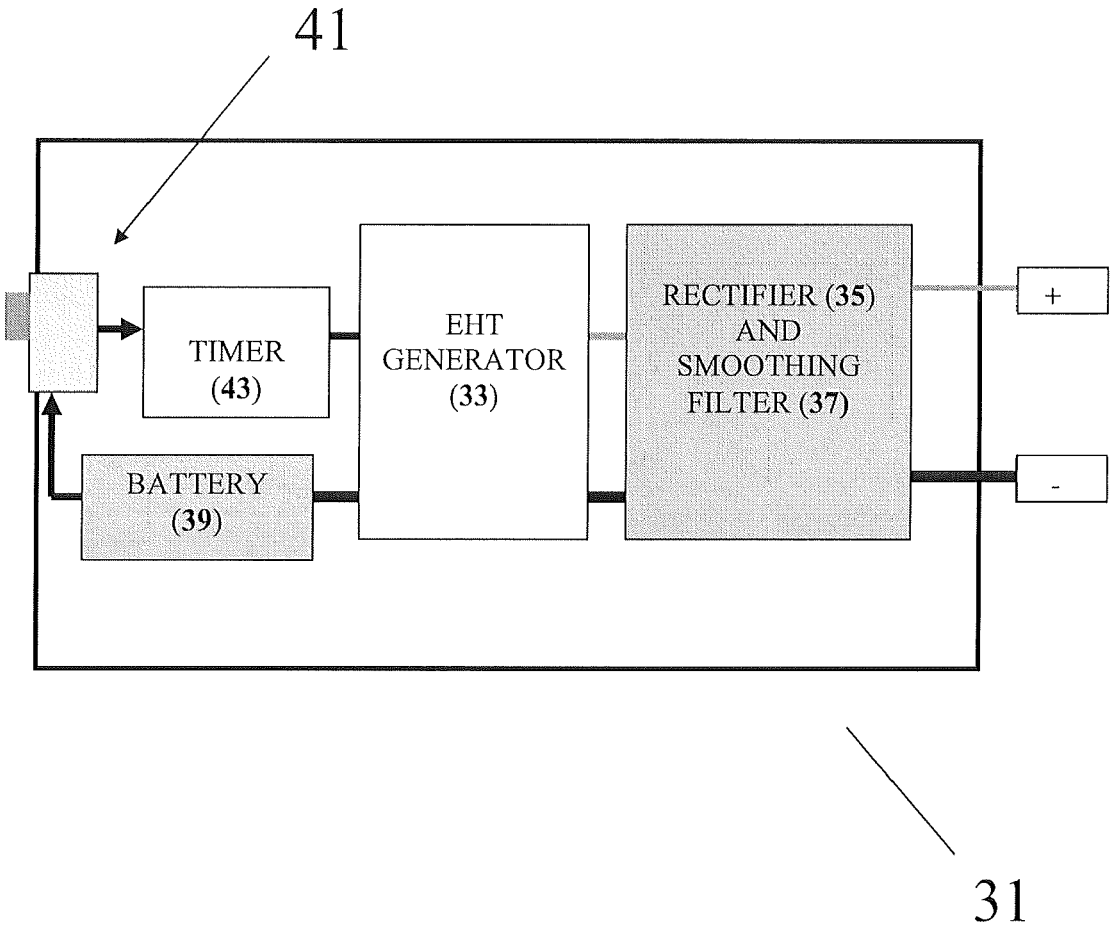
FIG. 7 schematically illustrates a static restorer.

FIG. 7 shows a block diagram, illustrating a static restorer 31. The static restorer 31 increases the surface potential of an electret element. The static restorer 31 uses a high voltage field potential to force the internal molecular dipole to realign with the applied field. After realignment of the C—F bond by the external field, the internal molecular polarities increase the surface potential of the electret element.

The static restorer 31 includes a high voltage generator 33, also referred to in the art as an extra high tension (EHT) generator. The static restorer also includes an AC to DC rectifier 35, a smoothing filter 37, a battery 39, and a switch 41. The high voltage generator 33 is made using a low frequency oscillator and a voltage step-up transformer (not shown). Optionally, the high voltage generator includes a timer 43 to control the duration of EHT output.

Without the application of the static restorer, the surface potential of an electret element can decay, as shown in FIG. 8. In one example, a sample electret element was made from non-porous PTFE. The electret element initially had a surface potential of 11.5 KV. The electret element was then exposed to air for 6.5 hours. After this exposure, the surface potential was measured at 5.5 KV.

Figure 9:
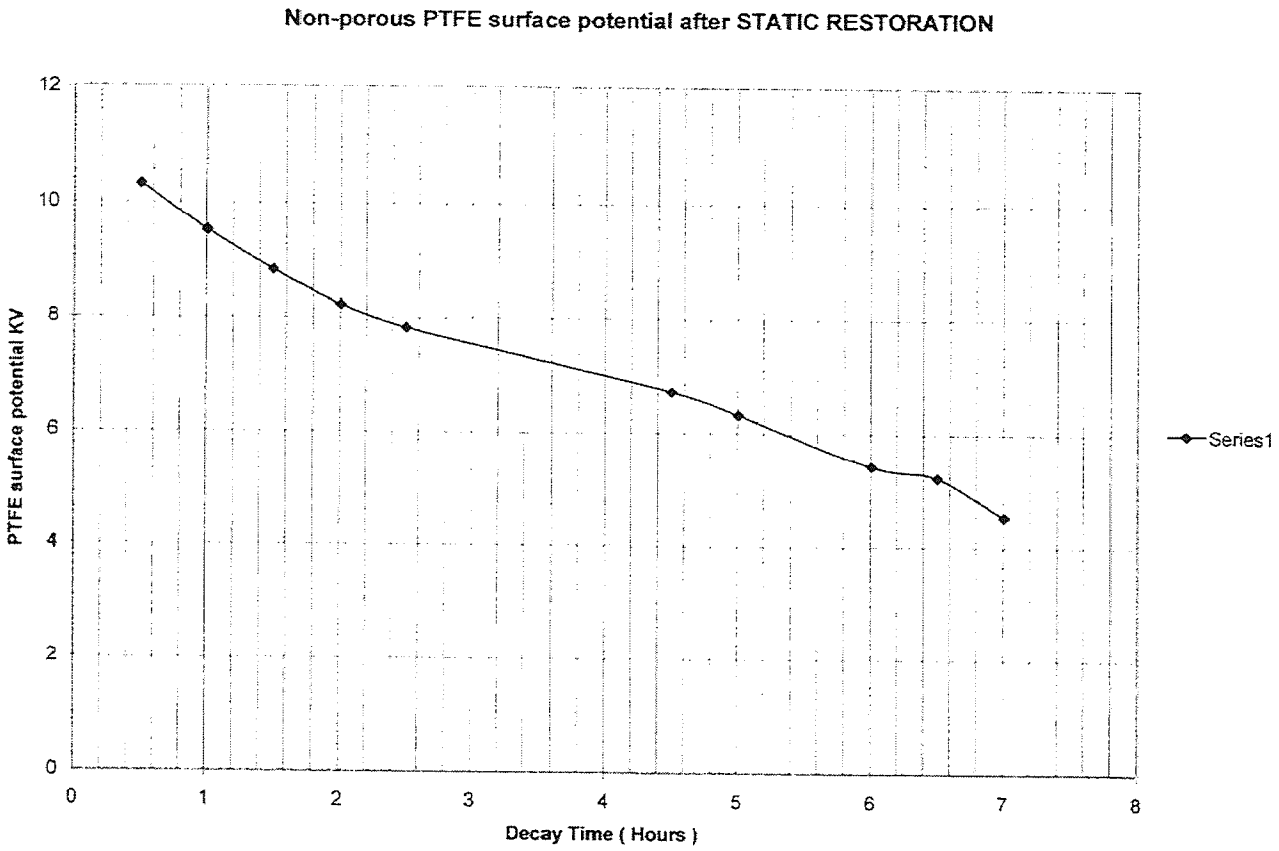
FIG. 9 is a graph illustrating the surface potential decay curve after application of the static restorer.

Using this same sample electret element, a static restorer having a 20 KV output was applied for 5 minutes. After this application, the surface potential increased to 10.5 KV. The sample electret element was then exposed to air for 5.6 hours. Afterwards, the surface potential decreased to 4.3 KV. A graphical representation of this decay is shown in FIG. 9.

Accordingly, air purifiers having electret modules and a static restorer are disclosed. While aspects of this invention have been shown and described, it will be apparent to those skilled in the art that many more modifications are possible without departing from the inventive concepts herein. The invention, therefore, is not to be restricted except in the spirit of the following claims.

What is claimed is:

1. An air purifier comprising:

headgear comprising a brim, the brim having an underside; and an electret module configured to capture airborne particles, the electret module comprising an electret element comprising a non-porous film, the electret module being affixed to the underside of the brim such that the electret element generates a static field toward a face of a wearer for capturing airborne particles.

2. The air purifier of claim 1, wherein the electret element is a fluoropolymer.

3. The air purifier of claim 1, wherein the electret element is non-porous polytetrafluoroethylene.

4. The air purifier of claim 1, the electret module further comprising:

a housing enclosing an interior space, the electret element located within the interior space; and an adhesive layer coupled to an exterior of the housing.

5. The air purifier of claim 4, wherein the housing is polyvinylchloride.

6. The air purifier of claim 4, wherein the static field generated by the electret element extends from the electret module to beyond the adhesive layer.

7. The air purifier of claim 1, further comprising a conductive layer, the electret element coupled to the conductive layer.

8. The air purifier of claim 1, the electret module further comprising an adhesive layer having an adhesive surface exposed to capture airborne particles.

9. The air purifier of claim 1, wherein the static field generated by the electret module extends from the electret module to eyes of a wearer of the headgear to capture the airborne particles.

10. The air purifier of claim 1, wherein the static field generated by the electret module extends from the electret module to a nose of a wearer of the headgear to capture the airborne particles.

11. The air purifier of claim 1, wherein the static field generated by the electret module extends from the electret module to a mouth of a wearer of the headgear to capture the airborne particles.

12. The air purifier of claim 8, wherein the adhesive layer is polyvinylchloride.

* * * * *